US012006105B2

(12) United States Patent
Liss et al.

(10) Patent No.: US 12,006,105 B2
(45) Date of Patent: Jun. 11, 2024

(54) LID FOR CONTAINER

(71) Applicant: Sully Innovations Inc., Toronto (CA)

(72) Inventors: Howard Liss, Concord (CA); Michael Liss, Concord (CA)

(73) Assignee: Sully Innovations Inc. (CA)

( * ) Notice: Subject to any disclaimer, the term of this patent is extended or adjusted under 35 U.S.C. 154(b) by 0 days.

(21) Appl. No.: 17/393,530

(22) Filed: Aug. 4, 2021

(65) Prior Publication Data

US 2022/0041348 A1 Feb. 10, 2022

Related U.S. Application Data

(60) Provisional application No. 63/061,079, filed on Aug. 4, 2020.

(51) Int. Cl.
*B65D 47/28* (2006.01)
*B65D 47/32* (2006.01)

(52) U.S. Cl.
CPC ..... *B65D 47/286* (2013.01); *B65D 47/32* (2013.01); *B65D 2543/00046* (2013.01); *B65D 2543/00092* (2013.01)

(58) Field of Classification Search
CPC ..... B65D 47/286; B65D 47/32; B65D 2543/00046; B65D 2543/00092; B65D 47/06; B65D 47/243; B65D 47/245; B65D 47/20; B65D 2251/0021; B65D 2543/00537; B65D 43/26; B65D 47/249; A47G 19/2272; A45F 3/18; A45F 3/16; A47J 41/0022; A47J 41/0027
USPC ..... 222/548; 220/254.1, 715, 254.3, 254.2, 220/254.9
See application file for complete search history.

(56) References Cited

U.S. PATENT DOCUMENTS

| | | | | |
|---|---|---|---|---|
| D751,338 | S | 3/2016 | Seiders et al. | |
| D751,339 | S | 3/2016 | Seiders et al. | |
| D751,340 | S | 3/2016 | Seiders et al. | |
| D751,341 | S | 3/2016 | Seiders et al. | |
| D761,619 | S | 7/2016 | Seiders et al. | |
| D803,619 | S | 11/2017 | Seiders et al. | |
| D834,882 | S | 12/2018 | Seiders et al. | |
| 10,232,992 | B2 | 3/2019 | Seiders et al. | |
| 10,486,868 | B2 * | 11/2019 | Spivey | B65D 43/22 |
| 11,077,995 | B2 * | 8/2021 | Pinelli | B65D 43/0229 |
| 2006/0201945 | A1 * | 9/2006 | Tedford | B65D 47/286 229/404 |
| 2014/0263476 | A1 * | 9/2014 | Blain | B65D 43/16 222/545 |
| 2017/0273484 | A1 * | 9/2017 | Spivey | A47G 19/2272 |

* cited by examiner

*Primary Examiner* — Don M Anderson
*Assistant Examiner* — John Martin Hoppmann
(74) *Attorney, Agent, or Firm* — Dority & Manning, P.A.

(57) ABSTRACT

A lid for covering a container has a lid body having a peripheral connection for connecting to the container, a first hole in the lid body, the first body having a first shape, a second hole in the lid body, the second hole having a second shape that is different from the first shape, and a slidable cover member that slides in a groove formed in the lid body between a covered position and an uncovered position to selectively cover and uncover the first hole. The lid includes a pivoting plug that pivots in a space between the ramps between a plugged position and an unplugged position to selectively plug the second hole.

12 Claims, 7 Drawing Sheets

LID FOR CONTAINER

CROSS-REFERENCE TO RELATED APPLICATIONS

This application claims priority from U.S. Provisional Patent Application 63/061,079 filed Aug. 4, 2020, which is incorporated herein by reference.

TECHNICAL FIELD

The present invention relates generally to lids for containers, particularly detachable and washable lids for drink or beverage containers.

BACKGROUND

There are various types of detachable and washable lids for containers such as drink or food containers. Most of these lids are press-fit onto an upper rim of the container. These lids are covers that are designed to provide a fluid-tight seal to prevent leakage of the liquid from the container. For drink or beverage containers, some lids have a closable drinking hole that can be opened while the lid is attached to the container to enable a user to drink from the container via the hole. Prior-art lids are typically designed for one type of drinking action.

An improved lid for a container that is reconfigurable to facilitate more than one type of drinking action is highly desirable.

SUMMARY

Disclosed in this specification is a lid for covering a container that has a lid body having a peripheral connection for connecting to the container, a first hole in the lid body, the first body having a first shape, a second hole in the lid body, the second hole having a second shape that is different from the first shape, and a slidable cover member that slides in a groove formed in the lid body between a covered position and an uncovered position to selectively cover and uncover the first hole. The lid includes a pivoting plug that pivots between a plugged position and an unplugged position to selectively plug the second hole.

The foregoing presents a simplified summary of the invention in order to provide a basic understanding of some aspects of the invention. This summary is not an exhaustive overview of the invention. It is not intended to identify essential, key or critical elements of the invention or to delineate the scope of the invention. Its sole purpose is to present some concepts in a simplified form as a prelude to the more detailed description that is discussed later. Other aspects of the invention are described below in relation to the accompanying drawings.

BRIEF DESCRIPTION OF THE DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION

Figure 1:
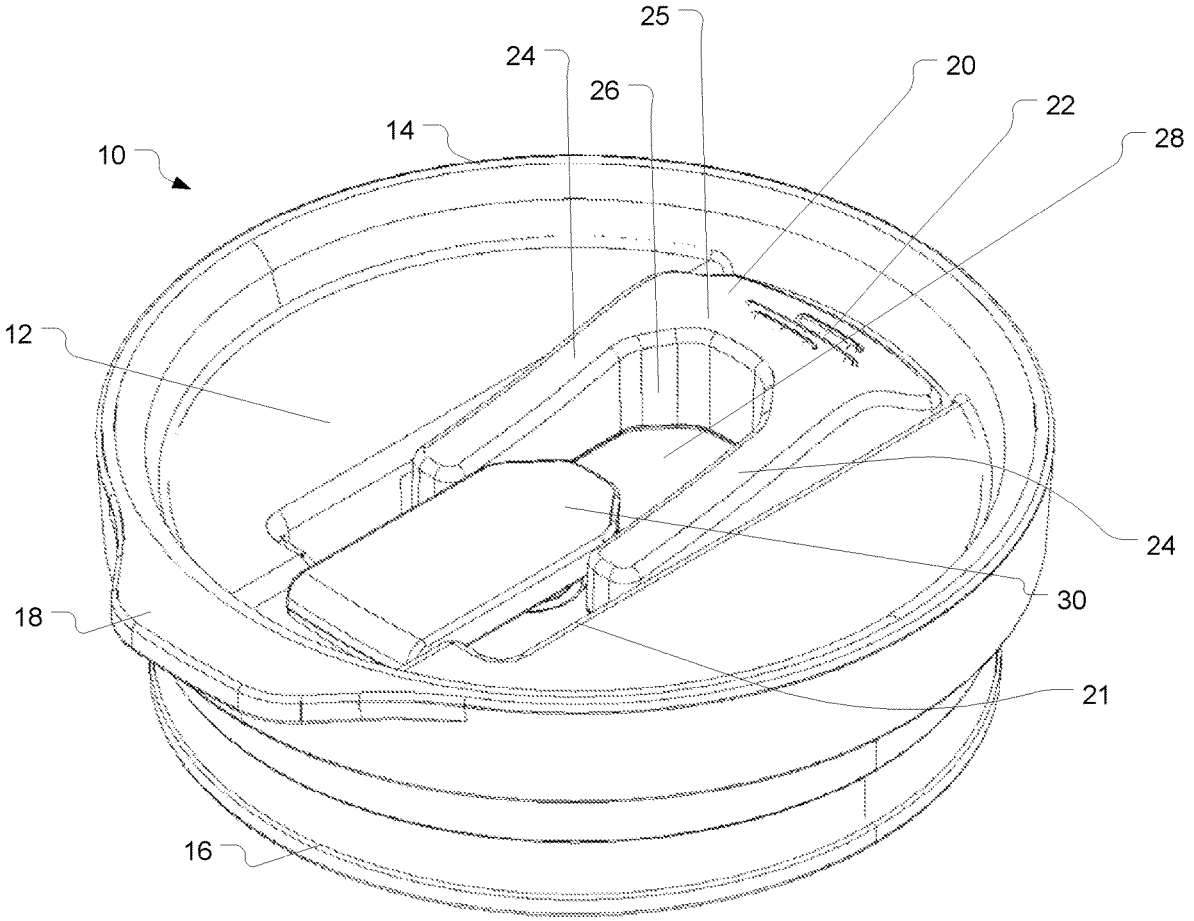
FIG. 1 is a perspective view of a lid for a container in accordance with an embodiment of the present invention, shown with its two holes closed.

Described herein and illustrated in the drawings is a novel lid for a container in accordance with one embodiment of the present invention. The container, which is not shown but well known in the art, may be a drink or beverage container. The container may also be a food container. The container may also be a container for non-food substances including liquids or solids.

FIGS. 1-7 depict a lid for covering a container in accordance with an embodiment of the present invention. The lid is generally denoted by reference numeral 10. The lid 10 includes a lid body 12 and an upper rim 14. The lid 10 has a lower portion having a peripheral connection 16 for connecting to the container. The peripheral connection may be shaped and sized to be press fitted into snug engagement with an upper rim of the container to provide a fluid-tight seal between the lid and the container. Any other alternative mechanical means for connecting, securing or fastening the lid to the container may be employed. The lid is generally circular although other shapes may be used to fit differently shaped containers.

In the embodiment depicted in FIGS. 1-7, the lid 10 has an optional lip 18 or handle to facilitate removal of the lid from the container. The lip may be used to pry the lid from the container.

The lid 10 is characterized by a slidable cover member that is configured to provide selective access to a first hole in the lid and is further characterized by a pivoting plug that is configured to provide selective access to a second hole in the lid, as will be described in greater below. Each of the first and second holes is independently covered or opened so that there are three operable configurations: (i) the first hole open and the second hole closed; (ii) the first hole closed and the second hole open; and (iii) both the first and second holes open. There is also a fourth fully closed configuration in which both the first and second holes are closed.

Figure 2:
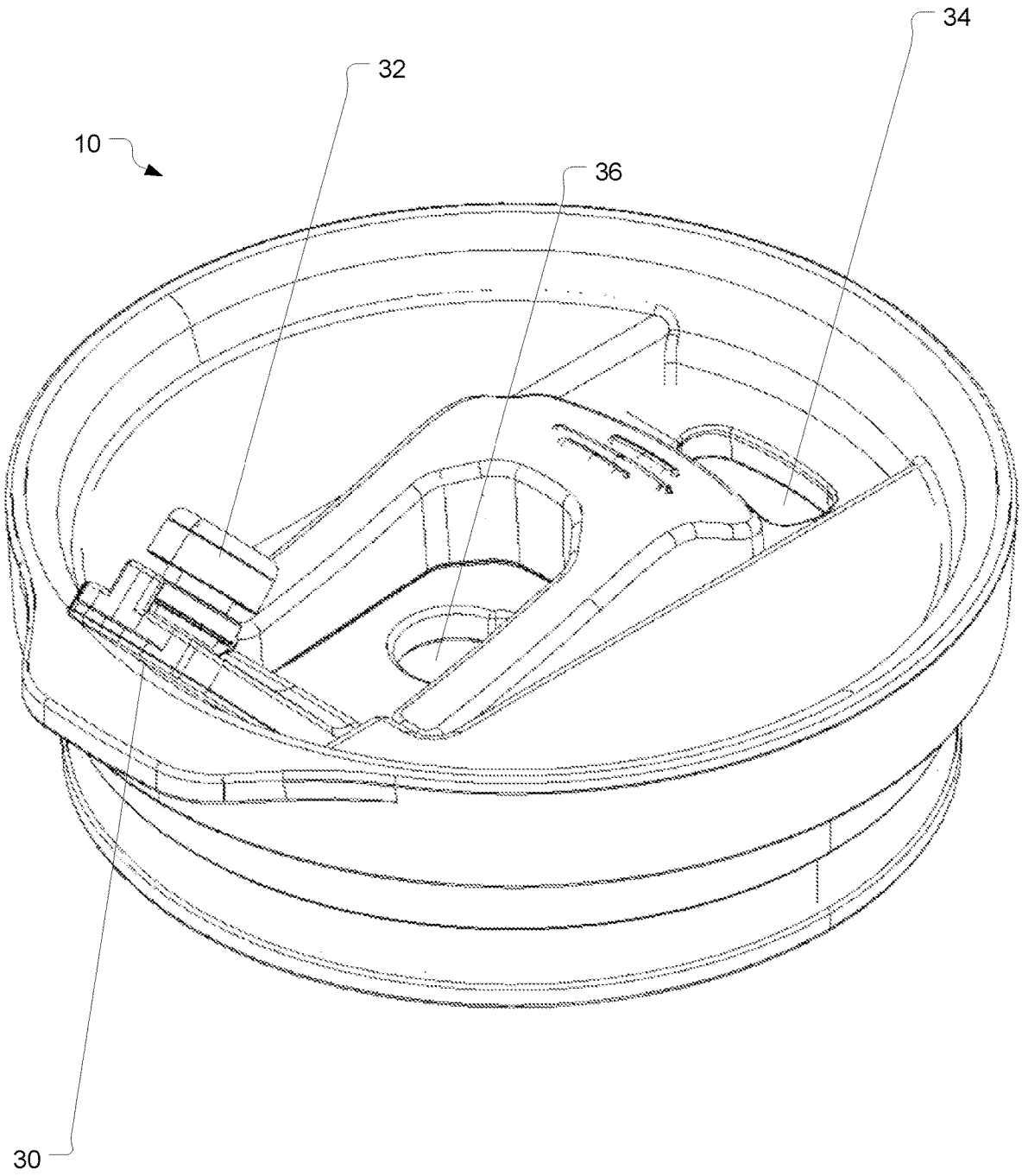
FIG. 2 is a perspective view of a lid for a container, shown with its two holes opened.
Figure 6:
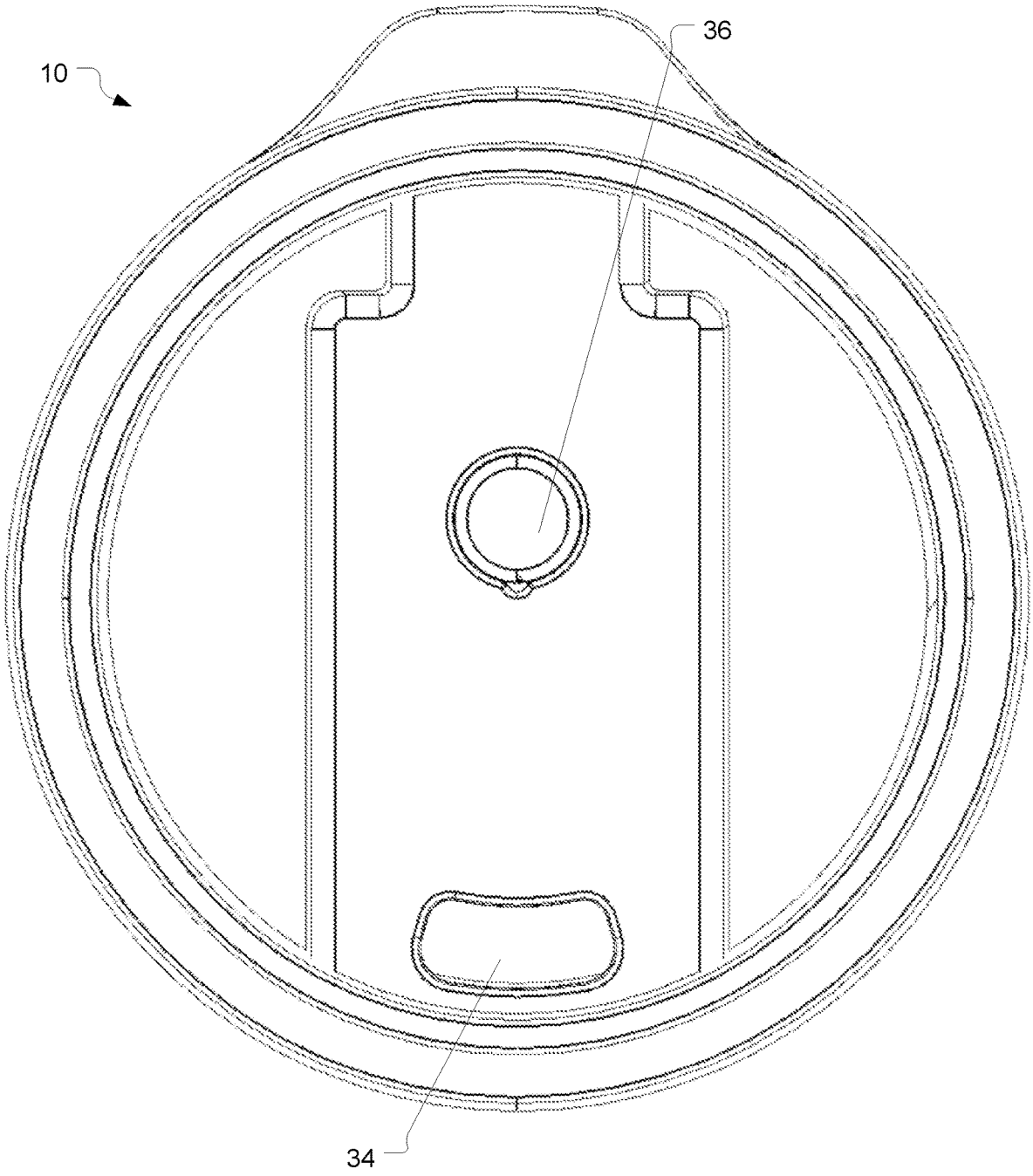
FIG. 6 is a bottom view of the lid.
Figure 7:
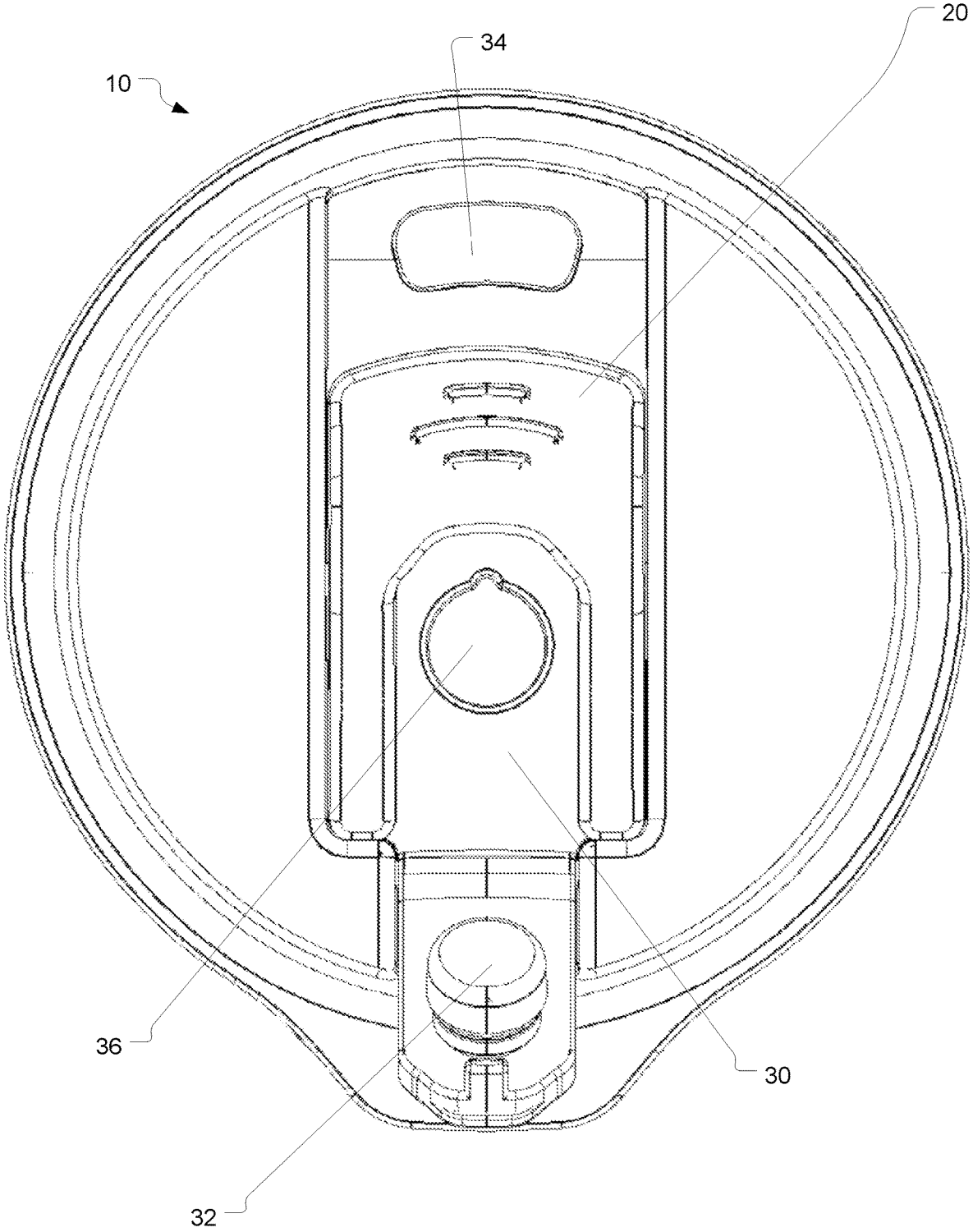
FIG. 7 is top view of the lid, shown with the holes opened.

As depicted in FIGS. 2, 6 and 7, the lid 10 has a first hole 34 in the lid body 12 and also has a second hole 36 in the lid body 12. The first and second holes are spaced apart. The first hole 34 has a first shape and the second hole 36 has a second shape that is different from the first shape. In the illustrated embodiment, the first shape of the first hole 34 is oblong (or generally oblong) whereas the second shape of the second hole 36 is circular (or generally circular). It will be appreciated that the first and second shapes may be different from what is illustrated. The first area of the first hole may be greater than, equal to, or less than the area of the second hole. In one specific implementation, the first hole is primarily designed to drink, sip or pour a beverage whereas the second hole is primarily designed to receive a drinking straw. In the embodiment illustrated, the first hole 34 is radially closer to a periphery of the lid body 12 than the second hole 36. As shown in this specific implementation, the first hole 34 is near the rim 14 to facilitate drinking. The second hole 36, in this specific implementation, is approximately in the center of the lid 10 or slightly offset from the center. In one specific embodiment, as illustrated in the figures, the radially outward side of the first hole 34 is generally parallel to the rim 14 to facilitate drinking, sipping or pouring.

Figure 3:
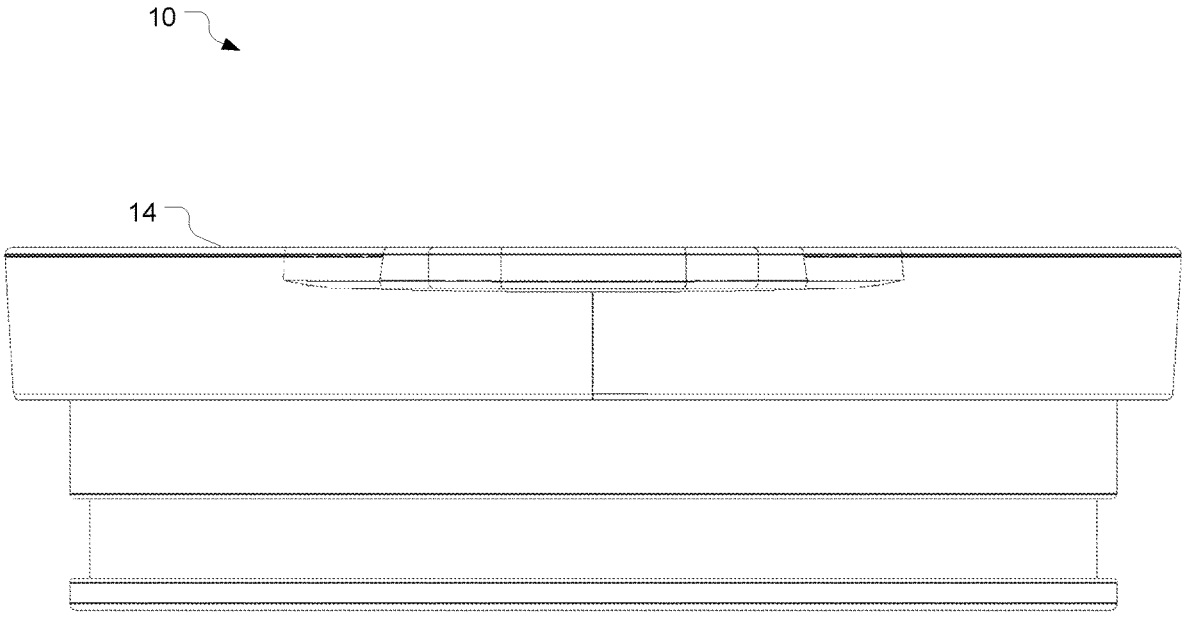
FIG. 3 is a front view of the lid.
Figure 4:
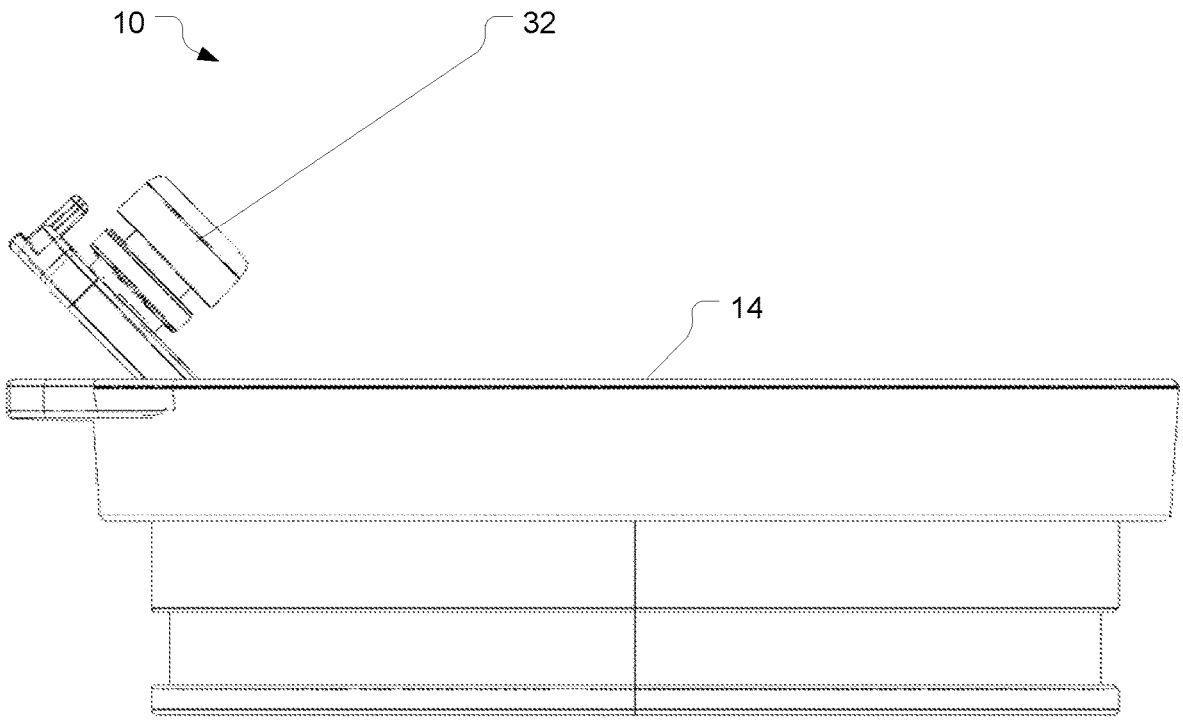
FIG. 4 is a side view of the lid, shown with the plug pivoted open.

As illustrated, the lid 10 has a slidable cover member 20 that slides in a groove 21 formed in the lid body 12. The slidable cover member 20 slides between a covered position and an uncovered position to selectively cover and uncover the first hole 34. The slidable cover member 20 may have ribs, ridges or grips 22 to provide friction for a finger or thumb to displace the slidable cover member 20 in a linear manner. The ribs, ridges or grips 22 are disposed on a steeply slanted face 27 of the slidable cover member 20. This steeply slanted face 27 slants steeply toward the first hole 34 and slants less steeply away from the second hole 36. As illustrated in FIGS. 1-3, the rim 14 extends at least as high as the upper portion of the slidable cover member 20. As illustrated, the slidable cover member 20 is movable to selectively cover the first hole 34. A pivoting plug 30, described in greater detail below, is movable to selectively cover the second hole 36 independently of whether the first hole 34 is covered or not.

Figure 5:
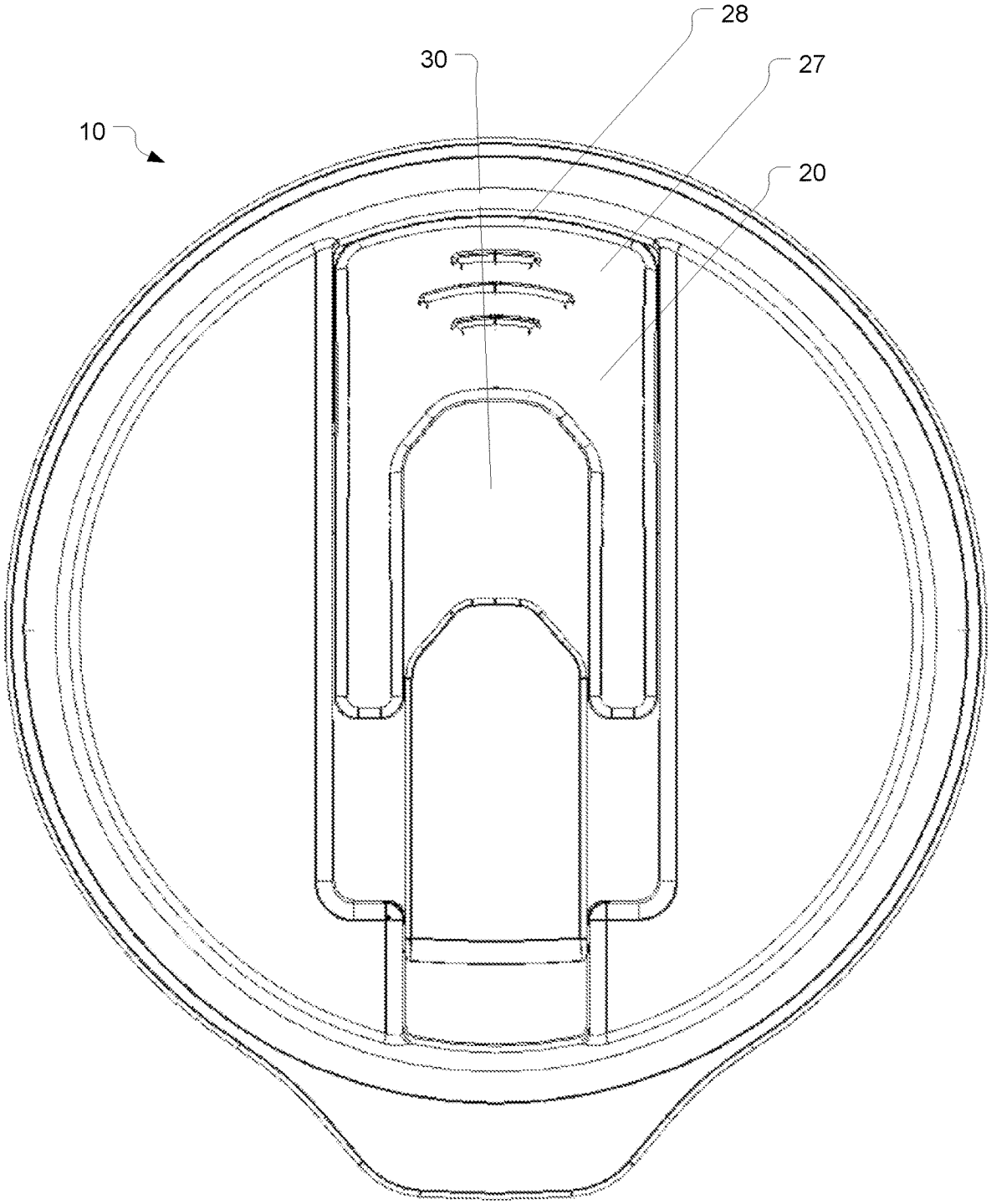
FIG. 5 is a top view of the lid, shown with the holes closed.

The slidable cover member 20 comprises a pair of ramps 24 that slope upwardly (in a radially inward direction) to an upper portion 25. The ramps 24 slope upwardly in a direction away from the lip 18 and towards the first hole 34. The ramps 24 have less of a slope than the steeply slanted face 27. The upper portion 25 includes a curved wall 26 as shown. The curved wall 26 generally corresponds in shape to the forward portion of the pivoting plug to permit the pivoting plug 30 to rotate without interference from the slidable cover member 20. The ramps 24 and curved wall 26 of the upper portion 25 define a generally U-shaped space between the ramps so that the slidable cover member 20 can be slid without interfering with the second hole 36 and the pivoting plug 30. In other words, the movement of the slidable cover member 20 does not block or impede access to the second hole so that a straw inserted into the second hole is not affected by the movement of the slidable cover member 20. The slidable cover member 20 has its steeply slanted face 27 terminating in a rounded end 28 having a curvature matching that of a rim 14 of the lid as shown in FIG. 5. As shown in FIGS. 1 and 5, the slidable cover member 20 has been slid into a forward ("closed") position in which it covers the first hole 34. In this position, the rounded end 28 of the slidable cover member 20 abuts the inside of the rim 14. In FIGS. 2 and 7, the slidable cover member 20 is shown displaced into a backward ("open") position in which it exposes the first hole 34. In the backward position, the radially outward ends of the ramps 24 abut corresponding shoulders formed in the lid body 12. As such, the slidable cover member 20 is slidable in the groove in the lid body 12 between two positions that are limited by the structure of the lid. Regardless of its position, the slidable cover member 20 does not interfere with the pivoting plug 30. In other words, the U-shaped structure of the slidable cover member 20 with its sloping ramps 24 enables the slidable cover member 20 to slide between the open and closed positions in the groove in the lid body while providing a gap or space between the ramps 24 in which the pivoting plug 30 can rotate. Accordingly, the slidable cover member 20 does not block or interfere with the pivoting plug 30 as it rotates to close or open the second hole 36.

The lid 10 further includes a pivoting plug 30 that is arranged to pivot between the ramps 24, i.e. without colliding or interfering with the ramps or other part of the slidable cover member 20. In the illustrated embodiment, the pivoting plug 30 pivots between a plugged position and an unplugged position to selectively plug the second hole. In the illustrated embodiment, the pivoting plug 30 is constrained to pivot radially outwardly about a pivot axis that is perpendicular to a sliding axis of the slidable cover member 20. Note that a sliding axis of the slidable cover member 20 in this illustrated embodiment is aligned with a diameter of the lid. The sliding axis thus notionally bisects the first and second holes, the pivoting plug 30 and the lip 18. The pivoting plug 30 is configured to pivot above the lip 18 as shown. Once a straw is inserted into the second hole 36, the straw blocks the pivoting plug 30 from accidentally or inadvertently closing the second hole 36. The slidable cover member 20 is ergonomically positioned relative to the first hole 34 and is, at least in some instances, reachable by a thumb or finger of one hand or the other, e.g. while holding the container. Since the slidable cover member 20 is slidable as opposed to pivotable, this slidable cover member 20 will not accidentally or inadvertently slide back over the first hole 34 without the user intentionally pulling it backward. This design is an improvement over other such lids where the drinking hole or spout is covered by a pivoting cover that may have a tendency to accidentally pivot back into a closed or partially closed position when the container is tilted for drinking.

The lid and container may advantageously be made of a polymer although another suitable material may be used.

The lid is generally round as depicted in the drawings with a vertical thickness that is less than a diameter of the lid. However, it will be appreciated that the inventive concept of the lid may be applied to lids of other shapes or proportions.

For the purposes of interpreting this specification, when referring to elements of various embodiments of the present invention, the articles "a", "an", "the" and "said" are intended to mean that there are one or more of the elements. The terms "comprising", "including", "having", "entailing" and "involving", and verb tense variants thereof, are intended to be inclusive and open-ended by which it is meant that there may be additional elements other than the listed elements.

This new technology has been described in terms of specific implementations and configurations which are intended to be exemplary only. Persons of ordinary skill in the art will appreciate that many obvious variations, refinements and modifications may be made without departing from the inventive concepts presented in this application. The scope of the exclusive right sought by the Applicant(s) is therefore intended to be limited solely by the appended claims.

The invention claimed is:

1. A lid for covering a container, the lid comprising:

a lid body having an upper portion of the lid body defining a rim and having a lower portion of the lid body defining a peripheral connection for connecting to the container;

a groove formed in the lid body, the groove extending diametrically from a first portion of the rim to a second portion of the rim, the groove further having a wide section having parallel sides and a narrow section also having parallel sides, the narrow section being defined by shoulders formed in the lid body where the wide section meets the narrow section;

a first hole in the groove of the lid body, the first hole having a first shape for drinking a liquid from the container;

a second hole in the groove of the lid body, the second hole having a second shape that is different from the first shape, the second hole being shaped for receiving a drinking straw;

a slidable cover member that slides in the wide section of the groove formed in the lid body between a covered position and an uncovered position to selectively cover and uncover the first hole, the slidable cover member having sloping ramps defining a U-shaped structure having a space between the ramps, wherein the ramps abut the shoulders when the first hole is uncovered; and a pivoting plug that pivots in the space between the ramps to move between a plugged position and an unplugged position to selectively plug or unplug the second hole.

2. The lid of claim 1 wherein the first shape is oblong and wherein the second shape is circular.

3. The lid of claim 1 wherein the pivoting plug pivots radially outwardly about a pivot axis that is perpendicular to a sliding axis of the slidable cover member.

4. The lid of claim 3 comprising a lip extending radially outwardly from a periphery of the lid such that the pivoting plug pivots above the lip.

5. The lid of claim 2 wherein the first hole is radially closer to a periphery of the lid body than the second hole.

6. The lid of claim 1 wherein the slidable cover member has a steeply slanted face that terminates in a rounded end having a curvature matching that of a rim of the lid.

7. The lid of claim 1 wherein the steeply slanted face has ribs, ridges or grips.

8. The lid of claim 1 wherein the rim extends at least as high as the upper portion of the slidable cover member.

9. The lid of claim 1 wherein the slidable cover member has a curved wall corresponding to a forward end of the pivoting plug.

10. A lid for covering a container, the lid comprising:

a lid body having a peripheral connection for connecting to the container and having an upper rim;

a groove formed in the lid body and extending to the upper rim, wherein the groove extends from a first portion of the rim diametrically to a second portion of the rim, the groove further having a wide section having parallel sides and a narrow section also having parallel sides, the narrow section being defined by shoulders formed in the lid body where the wide section transitions to the narrow section;

a first hole in the groove of the lid body, the first hole having a first shape for drinking a liquid from the container;

a second hole in the groove of the lid body, the second hole being shaped to receive a drinking straw;

a slidable cover member that is configured to slide in the groove between an uncovered position in which the first hole is exposed and a covered position in which the slidable cover abuts the upper rim and in which an underside of the slidable cover member is above the first hole to thereby cover the first hole, and wherein the slidable cover member has sloping ramps defining a U-shaped structure having a space between the ramps, wherein the ramps are configured to abut the shoulders when the slidable cover member is slid to expose the first hole; and a pivoting plug that pivots in the space between the ramps to move between a plugged position and an unplugged position to selectively plug or unplug the second hole.

11. The lid of claim 10 wherein the second hole has a second shape that is different from the first shape.

12. The lid of claim 10 wherein the slidable cover member has a steeply slanted face that terminates in a rounded end having a curvature matching that of the upper rim.

* * * * *